US005476130A

United States Patent [19]

Cheng

[11] Patent Number: 5,476,130

[45] Date of Patent: Dec. 19, 1995

[54] STEEL ROLLING DOOR

[76] Inventor: Sui K. Cheng, No. 24-36, Yun Kee, Si Ho Ts'un, Chih Tung Hsiang, Yunlin Hsien, Taiwan

[21] Appl. No.: 252,107

[22] Filed: Jun. 1, 1994

[51] Int. Cl.[6] ..... E06B 9/08

[52] U.S. Cl. ..... 160/133; 160/201; 160/DIG. 15

[58] Field of Search ..... 160/133, 291, 160/300, 302, 209, DIG. 15, 201

[56] References Cited

U.S. PATENT DOCUMENTS 2,723,715 11/1955 Kauffmann ..... 160/133

FOREIGN PATENT DOCUMENTS 814657 9/1951 Germany ..... 160/133
6616945 6/1967 Netherlands ..... 160/133
87072 1/1956 Norway ..... 160/133

*Primary Examiner*—Blair M. Johnson
*Attorney, Agent, or Firm*—Browdy and Neimark

[57] ABSTRACT

An improved steel rolling door is equipped with a a number of pivot plates which are engaged with each other side by side and pivotally associated with one side of the topmost collapsible door plate, and a plurality of pulling wires which are engaged with the opposite side thereof so as to permit the collapsible door plates to be adjusted from a horizontal position to a vertical position, i.e., from an opening position to a closing position, or vice versa. Moreover, the door plates are consecutively connected to each other one by one by way of a plurality of linking pieces and length variable linkage assembly units each including a pair of pivot parts and a connector so that the door plates can be easily and smoothly collapsed and rolled up along a rolling shaft without getting stuck in operation.

3 Claims, 9 Drawing Sheets

STEEL ROLLING DOOR

BACKGROUND OF THE INVENTION

The present invention relates to an improved steel rolling door particularly equipped with a number of consecutively connected pivot plates and a plurality of pulling wires and a plurality of length variable linkage assembly units which are engaged with a plurality of horizontal collapsible door plates in such a manner that the rolling collection of the rolling door can operate in a smooth way without getting stuck in one aspect and make the door plates adjustable between a horizontal position and a vertical position in another aspect.

Steel rolling doors have been popularly employed by stores in most big cities for security reasons. As shown in FIG. 2, the conventional steel rolling door 1 is generally equipped with a plurality of collapsible door plates 12 and a plurality of supporting rods 11, and a plurality of pivotal linking pieces 13 and a stop member 15 disposed at each end of the door plates 12 for retaining the supporting rods in place. The longitudinal edges of the plates 12 are curvedly bent in such a manner that the supporting rods 11 can be confined thererin. This door 1 can be adjusted to permit air and light to come in or to be blocked out by varying the angle of the door plates between a horizontal position and a vertical position piece by piece when the rolling door is put down.

As shown in FIGS. 3, 4, the adjustment of the angle of the door plates 12 can be effected by a slidable wall plate 22 disposed inside each slide track 2. Each slidable wall plate 22 is equipped with a pair of spring biased connecting rods 23 which can retractably pull the slidable wall plate 22 to one side and limit the door plates in a vertical position and the door plates 12 can only be turned horizontally and limited in that position when the door plates fully extend to the bottom and abut against the ground, forcing both the wall plates 22 in the slide tracks 2 to move to one side so as to permit the door plates 22 to turn horizontally and retained in that position. To roll the door 1 up, the door plates 12 are pivoted again vertically and retained in that state by the slidable wall plate 22.

Although, the door plates 12 of such conventional rolling door 1 can be adjusted in the operation angle thereof, they are not equipped with any adjusting device, making the adjustment difficult to effect. Moreover, the length of all the linking pieces 13 disposed between the door plates 12 is fixed and identical; thus, the door plates 12 can easily get stuck in a rolling operation.

SUMMARY OF THE INVENTION

The primary object of the present invention is to provide an improved steel rolling door which is equipped with a number of consecutive pivot plates and pulling wires so as to permit the door plates to be adjusted from a horizontal position to a vertical position i.e. from an opening position to a closing position or vice vice versa with ease.

Another object of the present invention is to provide an improved steel rolling door wherein collapsible door plates are engaged with each other one by one by linking pieces at one side and by length variable linkage assembly units at the opposite side so as to permit the door plates to be rolled up smoothly without getting stuck in operation.

DETAILED DESCRIPTION OF THE PREFERRED EMBODIMENT

Figure 1:
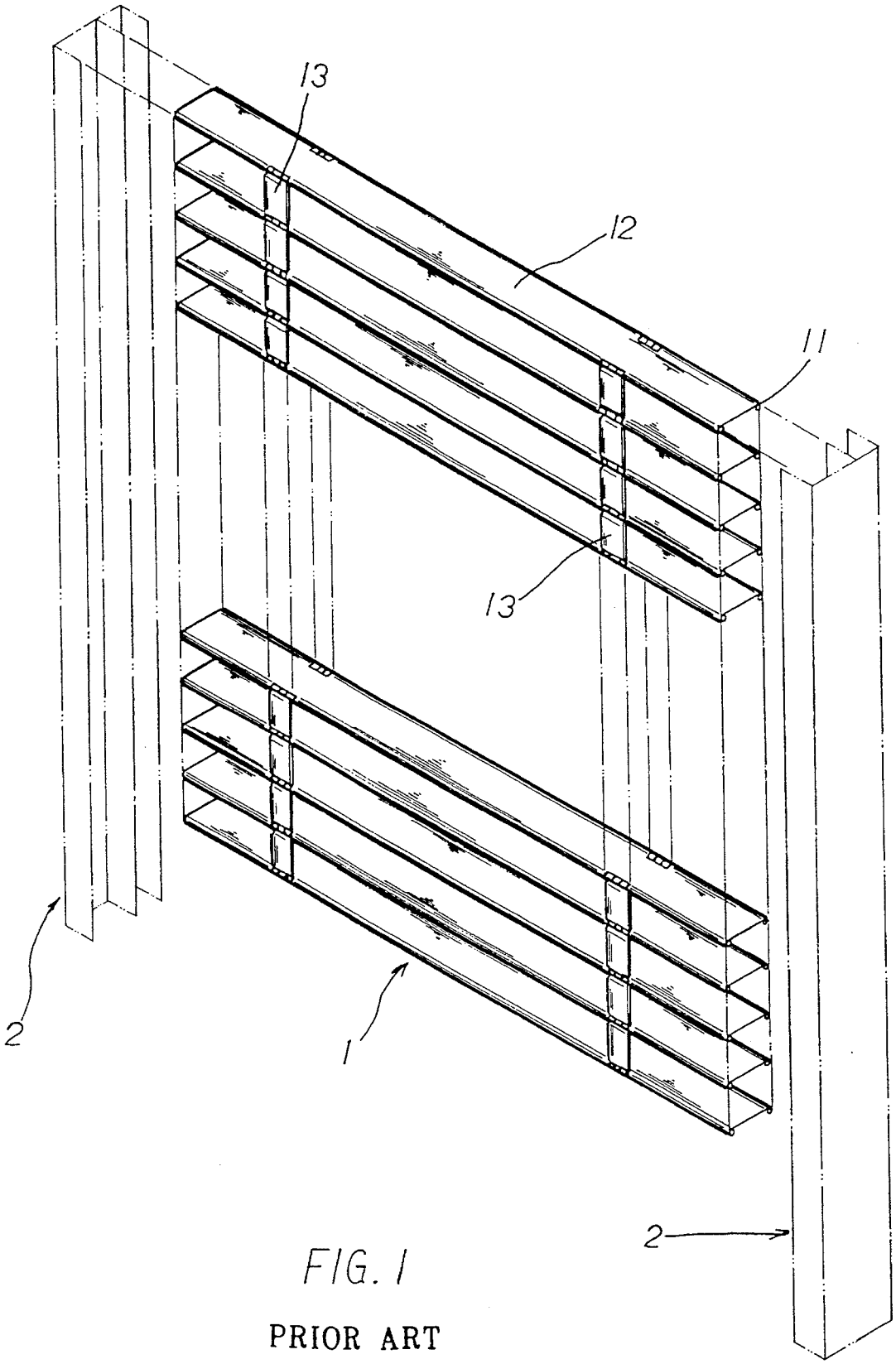
FIG. 1 PRIOR ART
FIG. 1 is a diagram showing a prior art steel rolling door.
Figure 2:
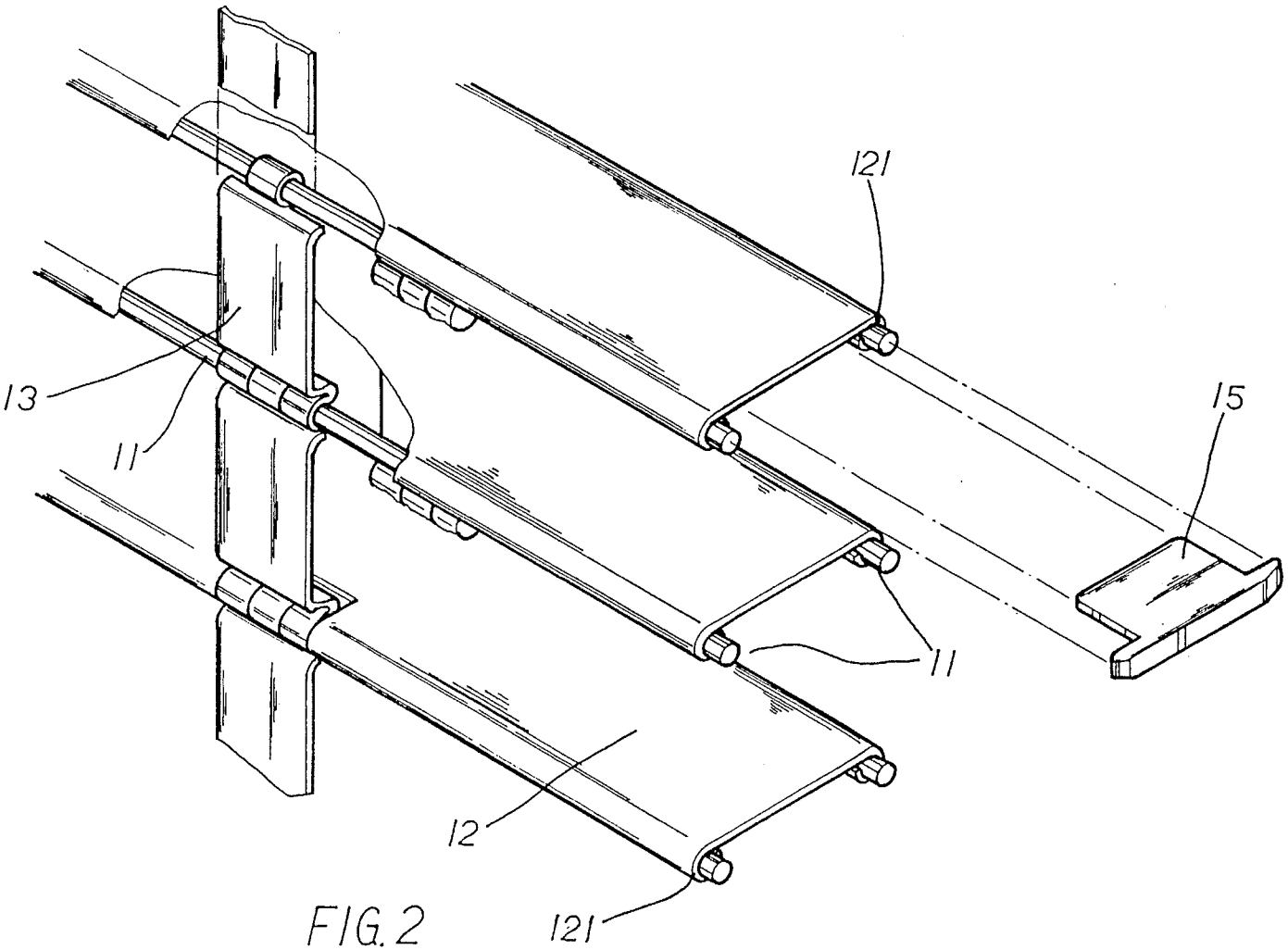
FIG. 2 PRIOR ART
FIG. 2 is a perspective diagram showing a partial portion of FIG. 1.
Figure 3:
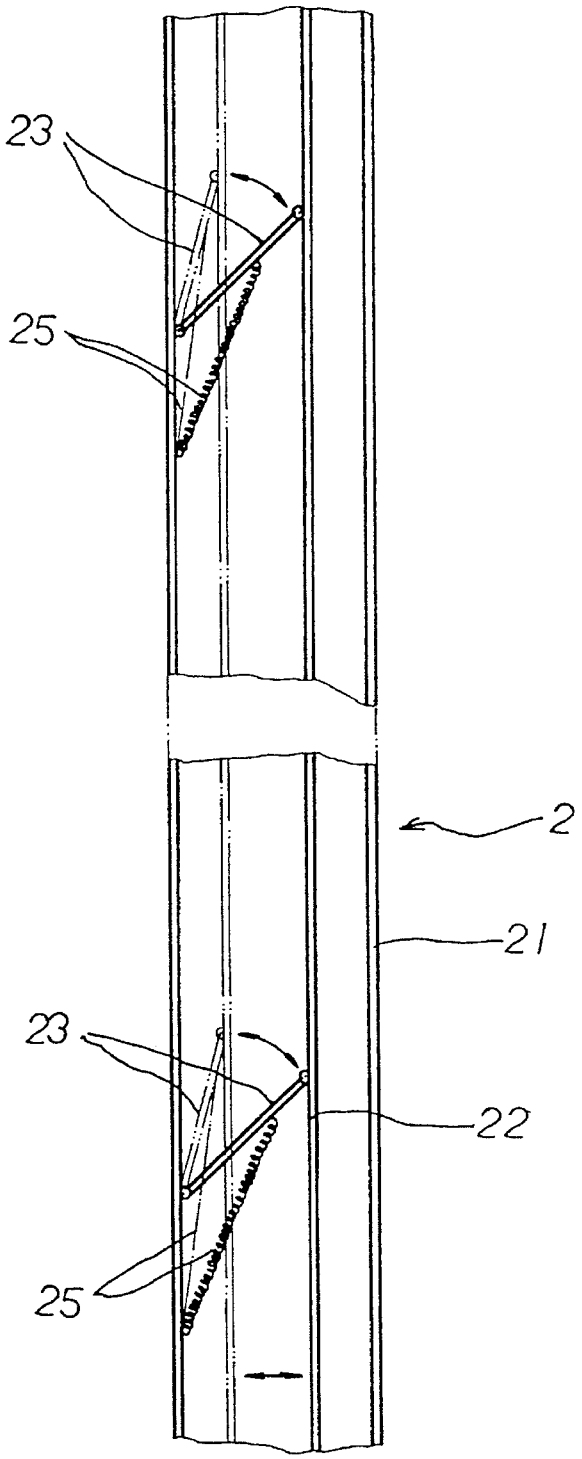
FIG. 3 PRIOR ART
FIG. 3 is a diagram showing the operation of the sliding track of a prior art rolling door.
Figure 4:
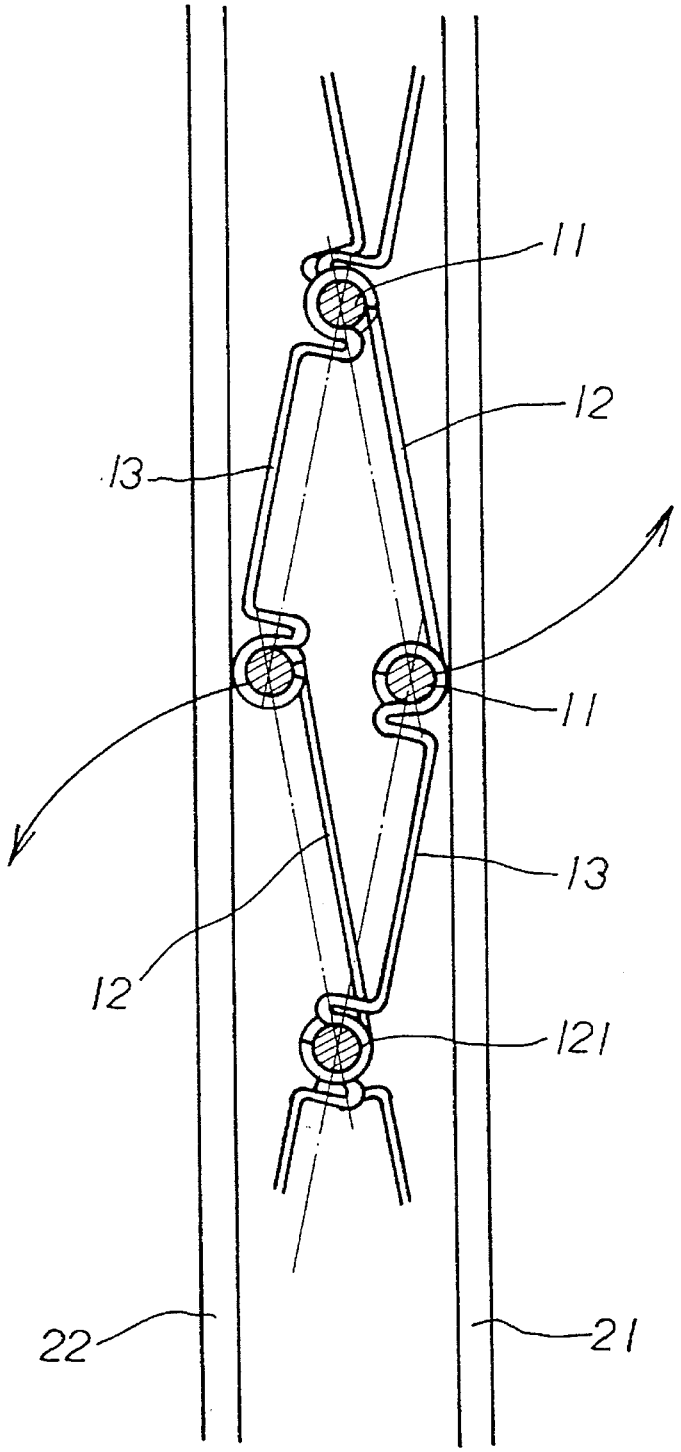
FIG. 4 PRIOR ART
FIG. 4 is a diagram showing the operation of a prior art rolling door.
Figure 5:
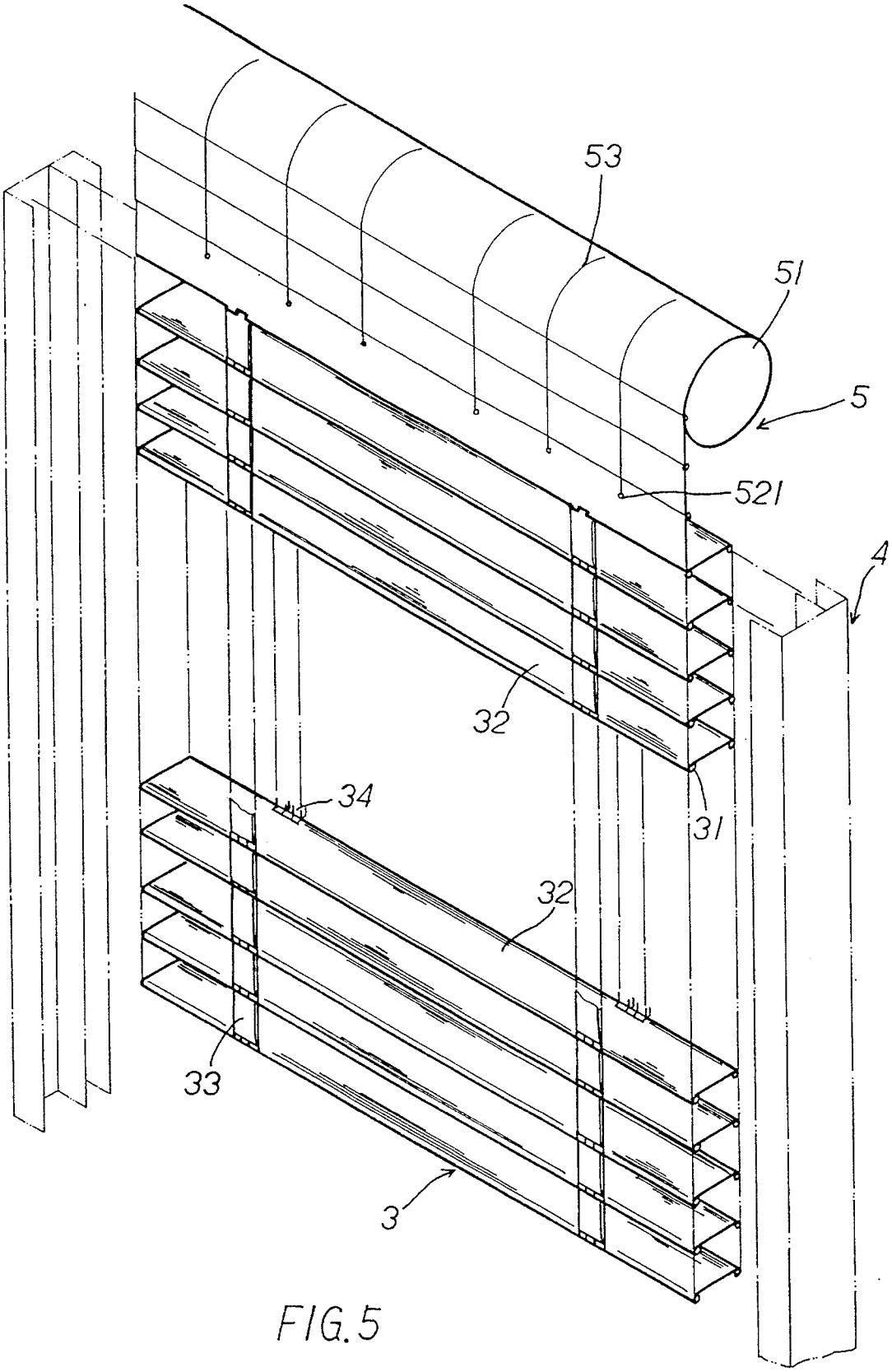
FIG. 5 is a diagram showing the rolling door of the present invention.
Figure 6:
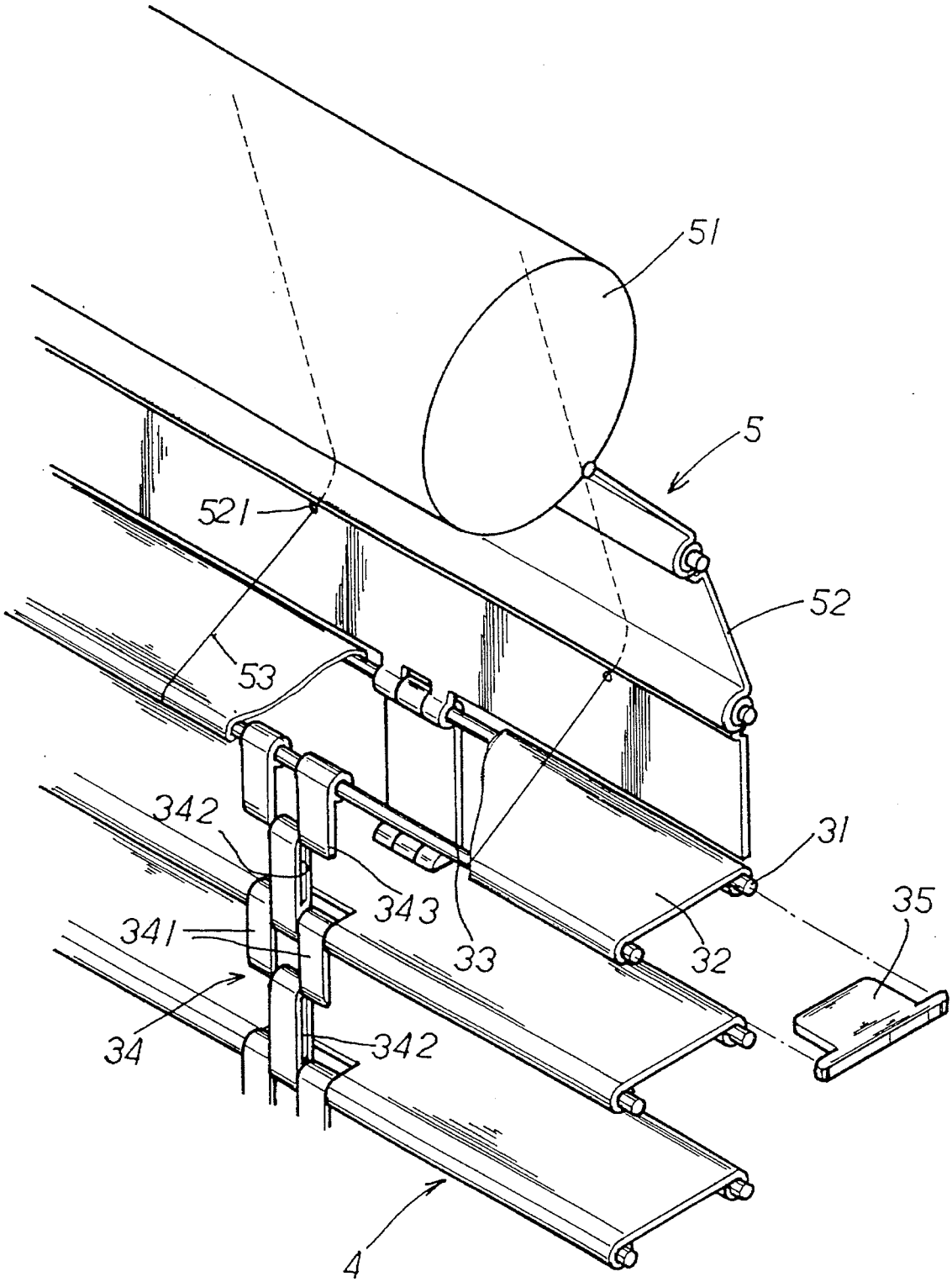
FIG. 6 is a perspective diagram showing a partial structure of the present invention.

Referring to FIGS. 5, 6, 7, 8, 9, the improved steel rolling door of the present invention is comprised of a rollable door assembly 3, sliding tracks 4 and a rolling device 5. The sliding tracks 4 have the same structure of the tracks of the above cited prior art rolling door.

The rollable door assembly 3 is comprised of a plurality of supporting rods 31, collapsible door plates 32, linking pieces 33, inner linkage assembly units 34 and stop pieces 35. The supporting rods 31, the collapsible door plates 32 and the stop pieces 35 are the same as the prior art.

Figure 9:
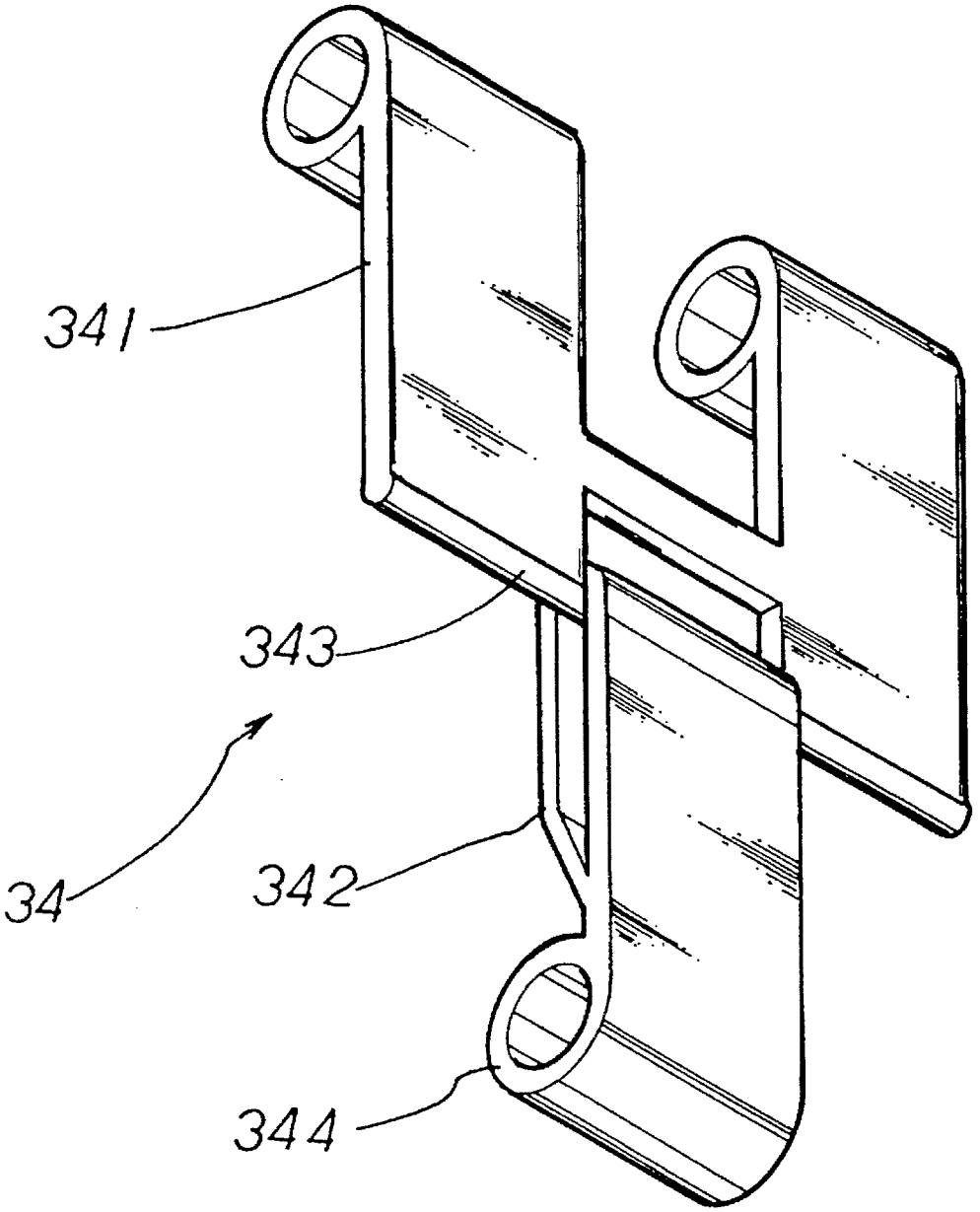
FIG. 9 is a perspective diagram showing the inner linking assembly unit of the present invention.

The linking pieces 33 identically structured as the prior art are secured to the outer sides of the door plates 32. Each inner linkage assembly unit 34 includes a pair of pivot parts 341 and a connector 342 wherein the pivot parts 341 are pivotally connected to one of the supporting rods 31 of one door plate 32 and the connecter 342 is pivotally associated with a pivot rod 343 which is integrally associated with the two pivot parts 341. As shown in FIG. 9, the bottom of the connector 342 is provided with a tubular portion 344 which is engaged with the corresponding supporting rod 31 disposed at the relatively inner edge of a door plate 32.

In rolling operation, the inner linkage assembly units 34 are forced to operate in such a manner that the connectors 342 are pivoted, causing the length of the inner linkage assembly units 34 to be reduced whereby the collapsible door plates 32 will not get stuck in operation.

The rolling device 5 is mainly comprised of a rolling shaft 51, a number of pivot plates 52 and a plurality of pulling wires 53. Driven by a motor is the rolling shaft 51. The pivot plates 52 are pivotally engaged with the rolling shaft 51 and associated with each other edge by edge and the last pivot plate 52 is coupled to the outer edge of the topmost door plate 32.

Figure 7:
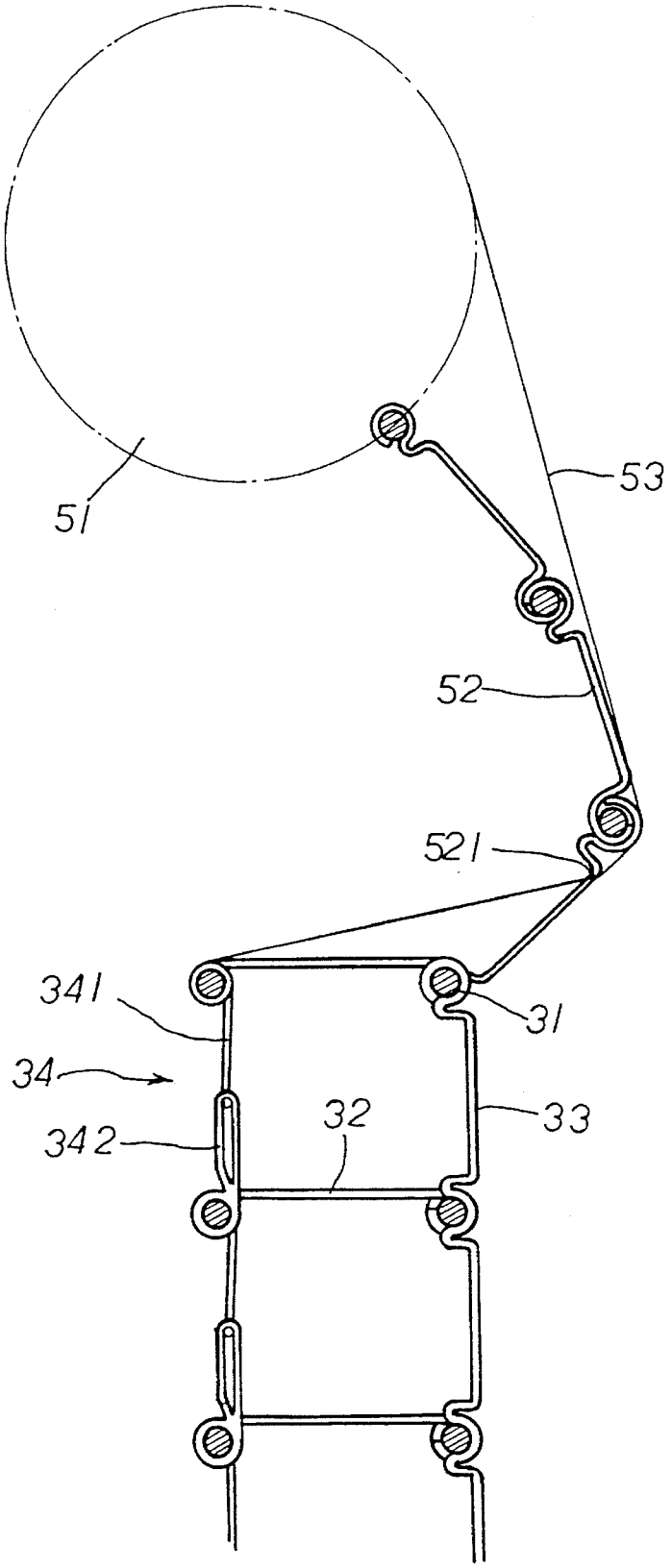
FIG. 7 is a diagram showing the opening of the present rolling door.

The pulling wires 53 are equally spaced and secured to the rolling shaft 51 at One end and are led through the through holes 521 respectively and further engaged with the inner side of the topmost door plate 32 at the other end. As shown in FIG. 7, each pulling wire 53 must be long enough to keep the topmost door plate 32 and the following parallel door plates in a horizontal position when the door plates 32 are put in an open state. The pivot plates 52 pivotally are connected to each other and supported by the wires 53, as shown in FIG. 7, curvilinearly.

Figure 8:
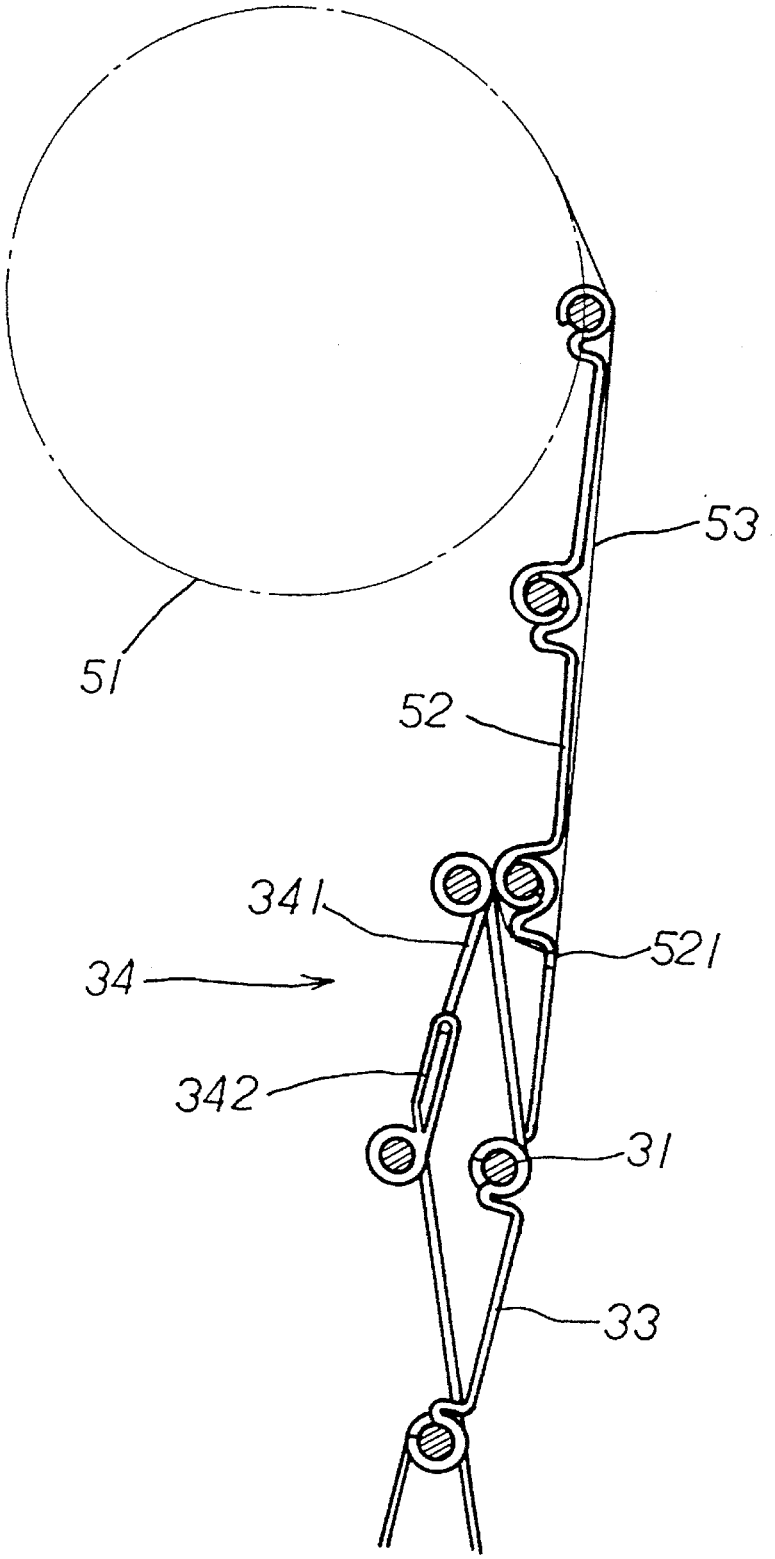
FIG. 8 is a diagram showing the closing of the present invention.

As the rolling door of the present invention begins to be rolled up, the pulling wires 53 are first wound up, causing the topmost door plate 32 and the other consecutive door plates to be positioned vertically. Referring to FIG. 8, the consecutive pivot plates 52 are pulled gradually to vertically line UP as the rolling shaft 51 is continuously spinned. Afterwards, the pivot plates 52 and the door plates 32 are collected on the rolling shaft 51.

To get the pivotal door plates 32 to line up and smoothly rolled up along the rolling shaft 51, each linkage assembly unit 34 must be shorter than each linking piece 33, the pivot parts 341 and the connector 342 are freely to pivot with respect to each other so as to effect the variation of the linkage assembly unit 34.

It can be clearly seen that the use of the pulling wires which are engaged with the inner side of the topmost door plate at one end and engaged with the rolling shaft at the other end permits the door plates to be varied from a horizontal position to a vertical position, i.e., from an opening position to a closing position. Furthermore, the length variable linkage assembly units permit the rolling up operation of the door plates to be smooth and quietly.

I claim:

1. An improved steel rolling door having a motor driven rolling shaft, a plurality of collapsible door plates consecutively pivotally connected to each other by way of linking pieces, and a pair of sliding tracks in which the ends of said door plates are slidably confined, each said door plate having a supporting rod disposed along each of curvedly bent edges of said door plate, each end of said door plate having a stop means for limiting said supporting rods in place; said motor driven rolling shaft being used to roll the collapsible door plates continuously thereon in a receiving operation or to unroll said door plates; wherein the improvement lies in that the rolling door has a plurality of pivot plates which are pivotally connected to each other side by side so as to make them foldable; a first pivot plate is engaged with the rolling shaft at one side and a last pivot plate is pivotally engaged with one side of a topmost door plate; and a plurality of pulling wires led through a plurality of through holes disposed on said last pivot plate are engaged with the opposite side of said topmost door plate from that which is pivotally engaged to said last pivot plate whereby said Collapsible door plates can be adjusted from a horizontal position to a vertical position or vice versa by actuation of said rolling shaft and said pivot plates and said pulling wires simultaneouly.

2. An improved steel rolling door as claimed in claim 1 wherein said collapsible door plates are pivotally connected at one side by linking pieces which are pivotally engaged with said supporting rods of two consecutive door plates, and a plurality of length variable linkage assembly units are engaged with the supporting rods at the opposite side of said two consecutive door plates which are on the same side of the topmost door plate with which are engaged said a plurality of said pulling wires.

3. An improved steel rolling door as claimed in claim 2 wherein each said length variable linkage assembly unit has a pair of pivot parts which are pivotally associated with a supporting rod of one of said collapsible door plates; and a connector which is pivotally engaged with said pivot parts at one end and is further pivotally engaged with a supporting rod of a consecutive door plate whereby said connector can be pivotally moved with respect said pivot parts in operation to vary the length of each said linkage assembly unit in operation.

* * * * *